US007454151B2

(12) United States Patent
Satoh et al.

(10) Patent No.: US 7,454,151 B2
(45) Date of Patent: Nov. 18, 2008

(54) IMAGE FORMING APPARATUS, FIXING UNIT HAVING A SELECTIVELY CONTROLLED POWER SUPPLY AND ASSOCIATED METHODOLOGY

(75) Inventors: Masahiko Satoh, Funabashi (JP); Akira Shinshi, Koto-ku (JP); Naoki Iwaya, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 380 days.

(21) Appl. No.: 11/289,297

(22) Filed: Nov. 30, 2005

(65) Prior Publication Data

US 2006/0165429 A1 Jul. 27, 2006

(30) Foreign Application Priority Data

Nov. 30, 2004 (JP) ..... 2004-346883

(51) Int. Cl.
*G03G 15/20* (2006.01)

(52) U.S. Cl. ..... 399/69; 399/70; 399/88

(58) Field of Classification Search ..... 399/67, 399/69, 70, 88
See application file for complete search history.

(56) References Cited

U.S. PATENT DOCUMENTS

| | | | | |
|---|---|---|---|---|
| 5,300,996 | A | 4/1994 | Yokoyama et al. | |
| 5,400,123 | A | 3/1995 | Sato et al. | |
| 5,832,354 | A | 11/1998 | Kouno et al. | |
| RE36,124 | E | 3/1999 | Yokoyama et al. | |
| 5,915,147 | A | 6/1999 | Kouno et al. | |
| 5,970,298 | A | 10/1999 | Seki et al. | |
| 6,305,636 | B1 | 10/2001 | Satoh et al. | |
| 6,393,233 | B1 * | 5/2002 | Soulier | 399/88 |
| 6,658,230 | B2 | 12/2003 | Satoh | |
| 6,771,925 | B2 | 8/2004 | Satoh | |
| 6,807,386 | B2 * | 10/2004 | Yasui et al. | 399/69 |
| 6,882,820 | B2 | 4/2005 | Shinshi et al. | |
| 7,099,602 | B2 * | 8/2006 | Asayama | 399/67 |
| 2004/0213606 | A1 | 10/2004 | Satoh | |
| 2005/0129432 | A1 | 6/2005 | Sato et al. | |
| 2005/0163543 | A1 | 7/2005 | Satoh et al. | |

FOREIGN PATENT DOCUMENTS

| | | |
|---|---|---|
| JP | 06-130856 | 5/1994 |
| JP | 10-010913 | 1/1998 |
| JP | 10-142999 | 5/1998 |
| JP | 11-258942 | 9/1999 |

(Continued)

OTHER PUBLICATIONS

U.S. Appl. No. 11/669,699, filed Jan. 31, 2007, Shinshi.

(Continued)

*Primary Examiner*—William J Royer
(74) *Attorney, Agent, or Firm*—Oblon, Spivak, McClelland, Maier & Neustadt, P.C.

(57) ABSTRACT

A fixing unit for use in an image forming apparatus includes a fixing member, a heating source, and a controller. The fixing member is supported rotatably. The heating source heats the fixing member. The controller controls power supply to the heating source. The controller controls a first average power supply, supplied to the heating source before rotating the fixing member, to be larger than a second average power supply, supplied to the heating source after rotating the fixing member.

12 Claims, 7 Drawing Sheets

FOREIGN PATENT DOCUMENTS

| | | |
|---|---|---|
| JP | 2001-265159 | 9/2001 |
| JP | 2002-082570 | 3/2002 |
| JP | 3605595 | 10/2004 |
| WO | WO 01/48559 A1 | 7/2001 |

OTHER PUBLICATIONS

U.S. Appl. No. 11/116,354, filed Apr. 28, 2004, Satoh et al.
U.S. Appl. No. 11/521,472, filed Sep. 15, 2006, Shinshi, et al.
U.S. Appl. No. 11/519,007, filed Sep. 12, 2006, Shinshi, et al.

* cited by examiner

IMAGE FORMING APPARATUS, FIXING UNIT HAVING A SELECTIVELY CONTROLLED POWER SUPPLY AND ASSOCIATED METHODOLOGY

The present invention generally relates to a fixing unit for use in an image forming apparatus such as a copier, printer, and facsimile, and an image forming apparatus including the fixing unit, and a method of controlling the fixing unit.

BACKGROUND OF THE INVENTION

Generally, an image forming apparatus such as a copier, printer, and/or facsimile includes a fixing unit to fix a toner image on a recording medium. Such recording mediums include a transfer sheet and an over head projector (OHP) sheet. The fixing unit fixes the toner image on the recording medium by applying heat to the toner image through a fixing member heated by a heating source.

For example, the fixing unit may employ a heat roll method or a belt fixing method. In the case of the heat roll method, a heating source such as a halogen heater heats a fixing roller, which is pressed by a pressure roller. The fixing roller and the pressure roller form a nip portion therebetween. In this way, a toner image can be fixed to a recording medium by applying heat and pressure to the toner image on the recording medium when the recording medium passes through the nip portion.

Recently, environmental concerns have prompted studies calling for the reduction of energy consumption in image forming devices. To reduce energy consumption of a fixing unit of an image forming apparatus, the consumption of the overall device needs to be considered.

To reduce energy consumption of the fixing unit of the image forming apparatus in a stand-by mode, the fixing roller can be maintained at a temperature, which is slightly lower than a fixing temperature. With such a method, when a user wants to start an image forming mode, the fixing roller can be heated to a fixing temperature in a shorter period of time. This method avoids longer waiting times before an image forming process is actually conducted. Accordingly, some electric power is consumed to maintain a temperature of the fixing unit when the image forming apparatus is in the stand-by mode.

Yet, it is preferable to reduce energy consumption during the stand-by mode of the image forming apparatus, and more preferable to reduce energy supply to zero during the stand-by mode of the image forming apparatus.

If energy supply to the fixing unit is set to zero during the stand-by mode, the fixing roller, which is mainly composed of metal having a larger heat capacity such as iron and aluminum, needs a relatively longer waiting time to be heated to a fixing temperature (e.g., 180 Celsius degree) when a user instructs an image forming mode. Such waiting time may be several minutes, for example. In such a case, a user is inconvenienced by such a long waiting period.

In order to shorten the heating time of the fixing unit, a fixing member can be heated at a temperature, which is higher than a fixing temperature before rotating the fixing member and a pressure member. A heating time of a fixing unit can also be shortened by increasing the power supplied to the fixing unit per unit time. For example, some image forming apparatuses have a configuration that can be connected to a power source having a higher voltage such as 200-voltage to attain a higher printing speed.

However, using a higher voltage power source may not be practicable in some geographical areas as a generally used commercial power source in such areas may utilize a lower voltage such as 100-voltage (with 15 amperes). A high voltage power source can be used in a lower voltage area such as Japan, but a special electrical arrangement is required to use the power source of higher voltage, thereby it is not practicable to use the power source of higher voltage to shorten the rise-up time of an image forming apparatus.

SUMMARY OF THE INVENTION

The present invention relates to a fixing unit for use in an image forming apparatus including a fixing member, a heating source, and a controller. The fixing member is supported rotatably and heated by a heating source. The controller controls power supply to the heating source to control a first average power supply, supplied to the heating source before rotating the fixing member, to be larger than a second average power supply, supplied to the heating source after rotating the fixing member.

In a further aspect of the invention, a first average power supply is supplied to the heating source before rotating the fixing member, and a second average power supply is provided to the heating source after rotating the fixing member. The first average power supply is controlled to be larger than the second average power supply.

It is to be understood that both the foregoing general description of the invention and the following detailed description are exemplary, but are not restrictive, of the invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

DETAILED DESCRIPTION OF THE INVENTION

Figure 1:
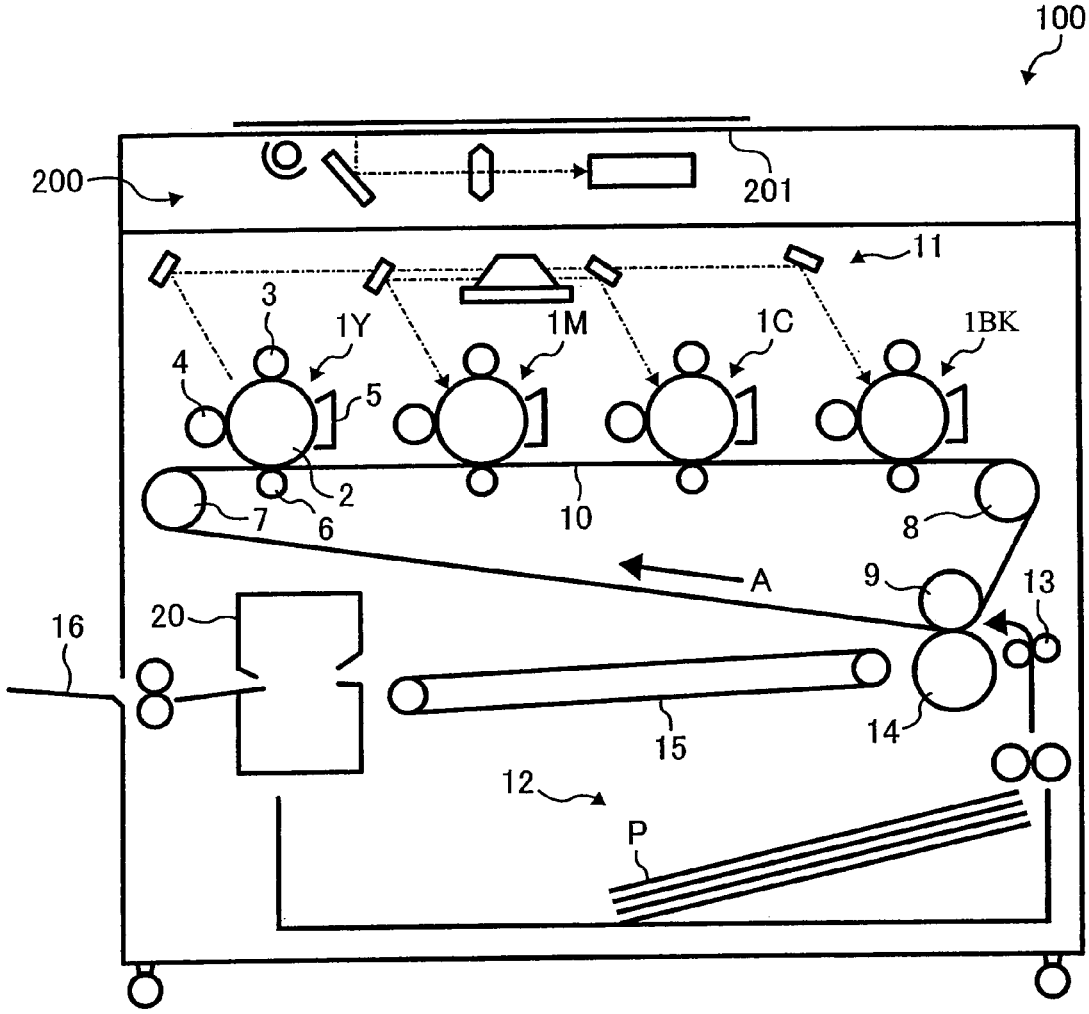
FIG. 1 is a schematic cross-sectional view of an image forming apparatus according to an exemplary embodiment of the invention.

Certain terminology is used in the following description for convenience only and is not limiting. The words "over," "right," "left," "lower," and "upper" designate directions in the drawings to which reference is made. The words "inwardly" and "outwardly" refer to directions toward and away from, respectively, the geometric center of the image forming apparatus in accordance with the present invention, and designated parts thereof. The terminology includes the words noted above as well as derivatives thereof and words of similar import.

In describing example embodiments shown in the drawings, specific terminology is employed for the sake of clarity. However, the disclosure of this present invention is not intended to be limited to the specific terminology so selected and it is to be understood that each specific element embraces technical equivalents known to those skilled in the art.

Referring now to the drawings, wherein like reference numerals designate identical or corresponding parts throughout the several views, an image forming apparatus is described with reference to FIG. 1.

FIG. 1 is a schematic cross-sectional view of an image forming apparatus, generally designated 100 according to an exemplary embodiment. For example, the image forming apparatus 100 may be a full color image forming apparatus of a tandem type employing electrophotography methodology.

As shown in FIG. 1, the exemplary image forming apparatus 100 includes a scanner 200, image forming units 1Y, 1M, 1C, and 1BK, an intermediate transfer belt 10, an optical writing unit 11, a sheet feed cassette 12, and a fixing unit 20. The intermediate transfer belt 10 is extended by support rollers 7, 8, and 9. Of course, those skilled in the art will recognize that alternative roller arrangements are possible.

As shown in FIG. 1, the intermediate transfer belt 10 is disposed in a substantially center portion of the image forming apparatus 100, and the four image forming units 1Y, 1M, 1C, and 1BK are arranged in a tandem manner along a surface of the intermediate transfer belt 10. Each of the image forming units 1Y, 1M, 1C, and 1BK includes a photosensitive drum 2 functioning as an image carrying member, a charge device 3, a developing device 4, a cleaning device 5, and a primary transfer device 6, for example.

Each of the image forming units 1Y, 1M, 1C, and 1BK has substantially similar configuration one to another except with respect to the color of developer used therein (i.e., toner color).

Although the image forming units 1Y, 1M, 1C, and 1BK for producing yellow, magenta, cyan, and black images are arranged in an order of 1Y, 1M, 1C, and 1BK from left to right in FIG. 1, those skilled in the art will recognize that alternative ordering is possible and that the exemplary such arrangement order is not limited to this example order.

As shown in FIG. 1, the optical writing unit 11 is provided over the image forming units 1Y, 1M, 1C, and 1BK. The optical writing unit 11 includes a light source (e.g., laser light), a polygon mirror, and a reflection mirror, for example. The optical writing unit 11 irradiates a respective laser beam to the respective photosensitive drum 2 of each of the image forming units 1Y, 1M, 1C, and 1BK.

As shown in FIG. 1, the sheet feed cassette 12 is disposed in a lower portion of the image forming apparatus 100. The sheet feed cassette 12 stores a recording medium P such as a transfer sheet and OHP sheet, and feeds the recording medium P to a pair of registration rollers 13. As shown in FIG. 1, a secondary transfer roller 14 (i.e., secondary transfer unit) is disposed in close proximity of the pair of registration rollers 13.

As above-mentioned, the exemplary intermediate transfer belt 10 is extended by the three support rollers 7, 8 and 9.

The secondary transfer roller 14 faces the support roller 9 by sandwiching the intermediate transfer belt 10 between the secondary transfer roller 14 and the support roller 9.

As shown in FIG. 1, a transport belt 15 is disposed in close proximity to the secondary transfer roller 14 to transport the recording medium P to the fixing unit 20 from the secondary transfer roller 14.

As shown in FIG. 1, the scanner 200 is disposed in an upper portion of the image forming apparatus 100. The scanner 200 includes a contact glass 201, an illuminating device, mirrors, a carriage, and a photoelectric converter, for example. The exemplary illuminating device emits a light beam to illuminate a document placed on the contact glass 201. The mirrors change a light path of reflection light from the document. The carriage holds such devices and can move in a predetermined direction. The exemplary photoelectric converter includes a charge coupled device (CCD) to convert the reflection light to an electric signal.

Hereinafter, an exemplary image forming method conducted in the image forming apparatus 100 is explained.

The scanner 200 illuminates images on a document, placed on the contact glass 201, with a light source to scan the document, and then converts the light to electric signals by the charge coupled device (CCD). The electric signals are then processed by an image process unit (not shown). The image process unit processes the electric signals to output image data for each color (e.g., yellow, cyan, magenta, and black).

The optical writing unit 11 irradiates a laser beam, modulated based on the image data, to the photosensitive drum 2 of the image forming units 1Y, 1M, 1C, and 1BK to form an electrostatic latent image for respective color on the photosensitive drum 2 of the image forming units 1Y, 1M, 1C, and 1BK.

The developing device 4 applies respective color toner to the electrostatic latent image to form a toner image (i.e., visible image) of respective color.

Then, each of the respective toner images are superimposingly transferred from each of the image forming units 1Y, 1M, 1C, and 1BK to the intermediate transfer belt 10, which travels in a direction shown by arrow A (i.e., clockwise direction) in FIG. 1. In this way, a full color image is transferred on the intermediate transfer belt 10.

The sheet feed cassette 12 feeds the recording medium P to the pair of registration rollers 13. Then, the pair of registration rollers 13 feeds the recording medium P to a secondary transfer nip, formed with the intermediate transfer belt 10, support roller 9, and secondary transfer roller 14 by adjusting a feed timing of the recording medium P with a traveling speed of the intermediate transfer belt 10 having the full color image thereon.

The recording medium P, which receives the toner image at the secondary transfer nip, is transported to the fixing unit 20 by the transport belt 15. The fixing unit 20 fixes the toner image on the recording medium P. Then, the recording medium P is ejected to and stacked on a tray 16 provided outside of the image forming apparatus 100.

The above-explained processes are related to an image forming process for full color image. However, an image forming process for monochrome image can be conducted in a similar manner.

Hereinafter, fixing units according to exemplary embodiments are explained in detail with reference to FIGS. 2 to 4.

Figure 2:
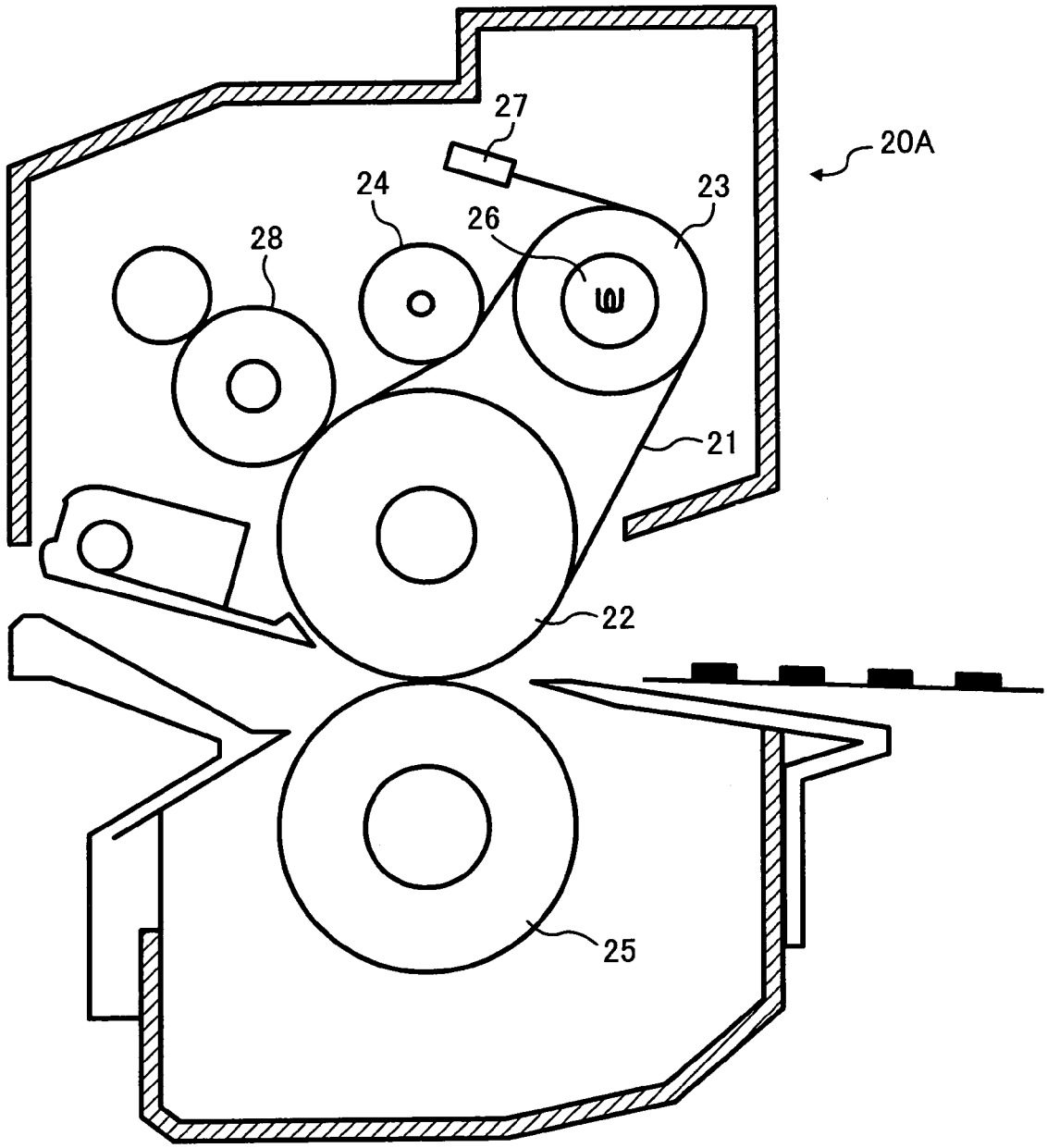
FIG. 2 is a schematic cross-sectional, view of a fixing unit according to an exemplary embodiment of the invention.

FIG. 2 is a schematic cross-sectional view of a fixing unit 20A of a belt-type fixing unit. The exemplary fixing unit 20A includes a fixing belt 21, a fixing roller 22, a heat roller 23, a tension roller 24, a pressure roller 25, and a cleaning roller 28.

The fixing belt 21 is extended by the fixing roller 22 and the heat roller 23, and is tensioned by the tension roller 24 so that the fixing belt 21 can closely contact the fixing roller 22 and the heat roller 23.

The pressure roller 25 faces the fixing roller 22 via the fixing belt 21 therebetween, and is pressed toward the fixing roller 22. In this way, a fixing nip is formed between the pressure roller 25 and the fixing roller 22 via the fixing belt 21.

In addition, as shown in FIG. 2, the cleaning roller 28 can contact the fixing belt 21 to clean the fixing belt 21.

The fixing belt 21 can be made of heat resistance resin formed in an endless film. The exemplary heat resistance resin includes polyimide, for example. Of course, those skilled in the art will recognize additional materials and compounds for providing a heat resistance resin.

The fixing belt 21 preferably has a thickness of 50 to 90 μm to maintain strength and flexibility of belt and to prevent waiving of the belt under a tensioned condition. The fixing belt 21 includes a base layer, an elastic layer, and a separation layer, for example.

The exemplary elastic layer formed on the base layer includes silicone rubber and fluorocarbon rubber, for example, and preferably has a thickness of 100 μm to 300 μm, for example. The elastic layer effects an image quality of printed image such as concentration unevenness, color unevenness, and glossiness unevenness, thereby the elastic layer preferably has a JIS-A hardness of 30 Hs or less, for example, wherein JIS is Japan Industrial Standard.

The exemplary separation layer (i.e., surface layer) includes perfluoroalkoxy (PFA) and polytetrafluoroethylene (PTFE), for example, and preferably has a thickness of 20 μm to 50 μm, for example. Those skilled in the art will recognize that the layer properties described above may be varied as to material without departing from the scope and spirit of the present invention as described herein.

As shown in FIG. 2, the exemplary heat roller 23 includes a heating source 26 inside the heat roller 23. The heating source 26 includes a halogen heater, an infrared ray heater, or a thermal resistance, for example.

As shown in FIG. 2, an exemplary temperature sensor 27 such as a thermistor is disposed closely to the heat roller 23 and the fixing belt 21 to detect a temperature of the fixing belt 21 and the heat roller 23.

Based on the temperature information detected by the temperature sensor 27, a fixing controller (not shown) controls power supply to the heating source 26 to control the surface temperature of the heat roller 23 and the fixing belt 21.

Furthermore, the pressure roller 25 can be heated by a heating source (not shown), as required. In this case, a temperature sensor (not shown) can be disposed in close relation to the pressure roller 25 to detect the temperature of the pressure roller 25, and the heating source 26 of the heat roller 23 may be controlled based on the temperature information detected by the temperature sensor (not shown) disposed closely to the pressure roller 25.

Temperature of the exemplary pressure roller 25 may affect the temperature of the fixing belt 21. For example, if the temperature of the pressure roller 25 is relatively higher, the fixing belt 21 may attain preferable fix-ability even if the temperature of the fixing belt 21 is relatively lower. Accordingly, it is preferable to use temperature information of the pressure roller 25 to control temperature of the heat roller 23.

The exemplary heat roller 23 includes metal such as iron and aluminum, for example. From the viewpoint of heat capacity, a smaller thickness is preferable for the heat roller 23. However, the heat roller 23 receives mechanical stress such as belt tension and a cutting process for giving surface smoothness, thereby the heat roller 23 needs some thickness to effectively counter such mechanical stress.

For example, in case of a smaller image forming apparatus, the heat roller 23 preferably has an outer diameter of 20 mm, and a thickness of 0.8 mm, for example.

Figure 6:
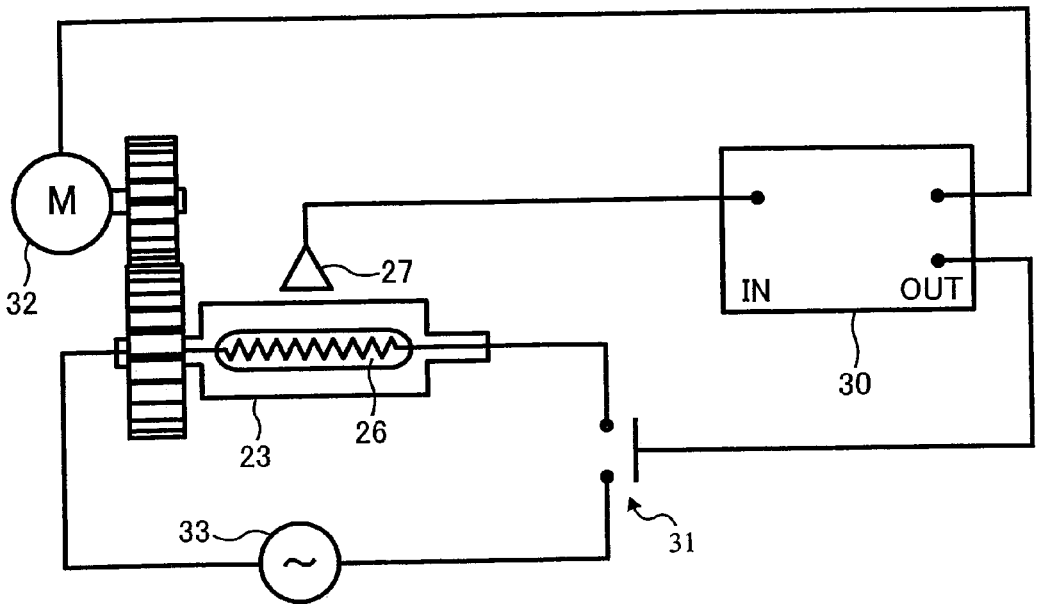
FIG. 6 is a schematic view of a driving system of a fixing unit and a temperature controlling system of a fixing unit.

The temperature sensor 27 measures the temperature on the heat roller 23 (or fixing belt 21). As shown in FIG. 6 to be described later, a controller 30 controls a switch 31 to control electric current to the heating source 26 based on such measured temperature.

Figure 3:
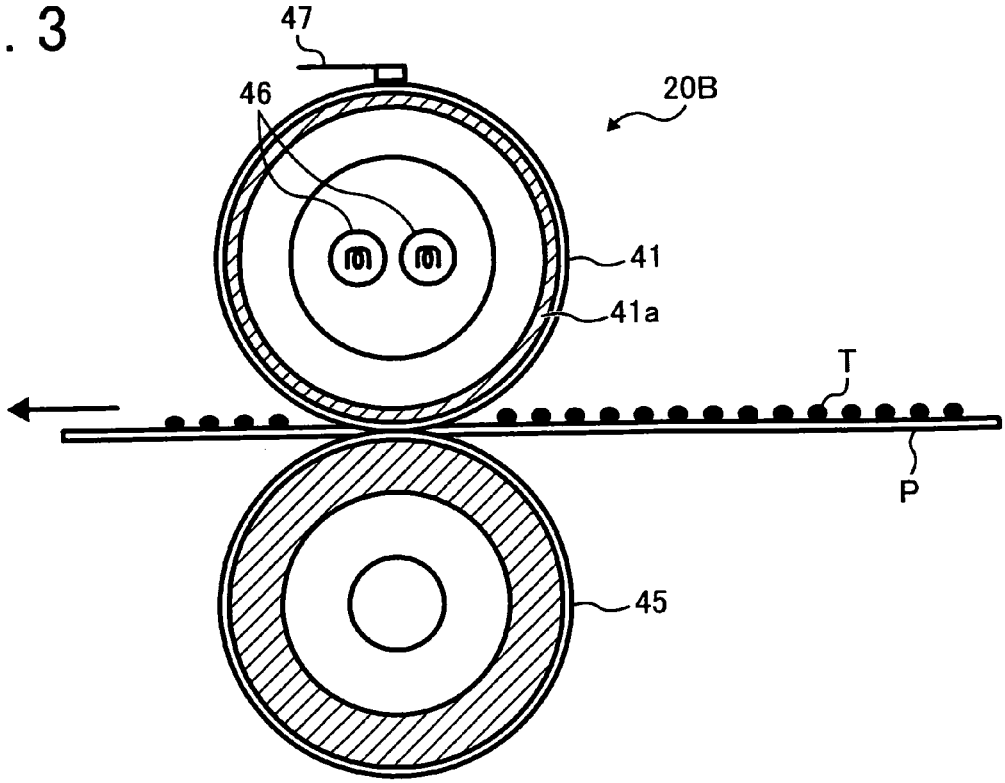
FIG. 3 is a schematic cross-sectional view of another fixing unit according to another exemplary embodiment of the invention.

FIG. 3 is a schematic cross-sectional view of a fixing unit 20B according to another exemplary embodiment, wherein the fixing unit 20B uses a heat roller method.

As shown in FIG. 3, the fixing unit 20B includes a fixing roller 41, and a pressure roller 45 pressed toward the fixing roller 41. The fixing roller 41 and the pressure roller 45 form a fixing nip therebetween.

As shown in FIG. 3, the fixing roller 41 includes a metal core 41*a*, and a heating source 46. The metal core 41*a* preferably has a thickness of 0.8 mm or less, for example. The heating source 46 includes a halogen heater, for example.

The exemplary pressure roller 45 includes a metal core and an elastic layer formed on the metal core.

Figure 4:
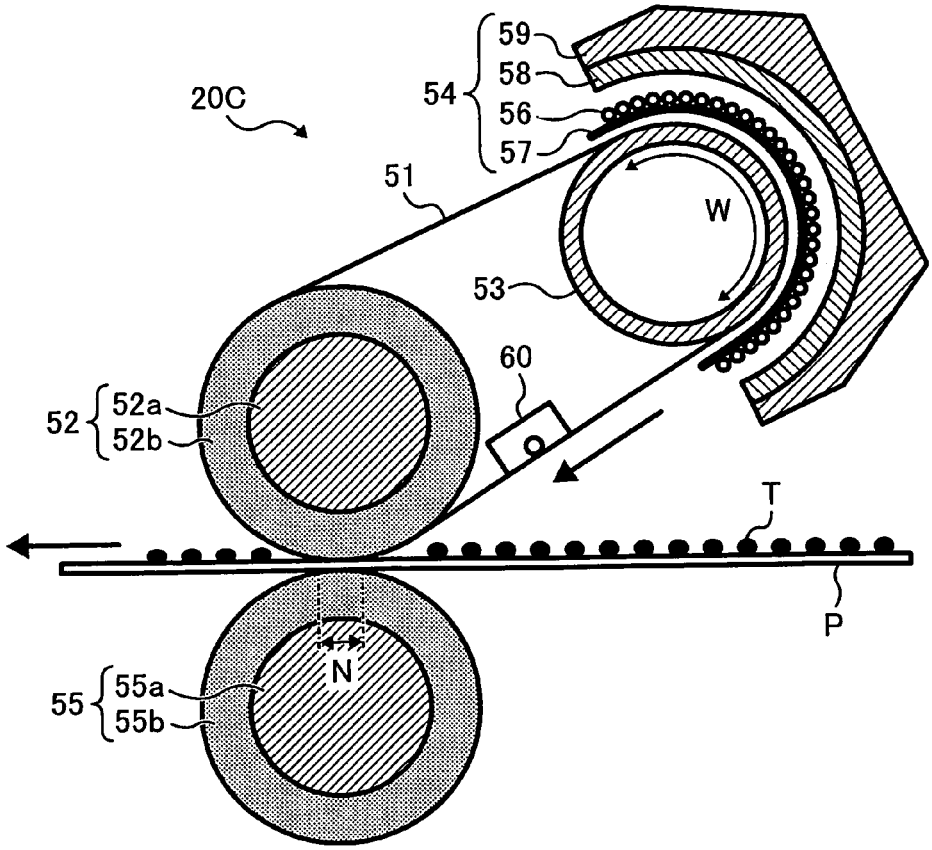
FIG. 4 is a schematic cross-sectional view of another fixing unit according to another exemplary embodiment of the invention.

FIG. 4 is a schematic cross-sectional view of a fixing unit 20C according to another example embodiment, wherein the fixing unit 20C uses an induction heating method.

As shown in FIG. 4 in this embodiment, the fixing unit 20C includes a fixing belt 51, a fixing roller 52, a heat roller 53, an induction heating unit 54, and a pressure roller 55.

The fixing belt 51 is extended by the heat roller 53 and the fixing roller 52, and is made of a heat resistance material formed in an endless film. The fixing belt 51 is heated by the heat roller 53 heated by the induction heating unit 54.

The fixing belt 51 can be driven in a direction shown by an arrow in FIG. 4 by a rotation of any one of the heat roller 53 and the fixing roller 52.

The pressure roller 55 is pressed toward the fixing roller 52 via the fixing belt 51, and rotates with the fixing roller 52.

The heat roller 53 can be made from magnetic metal such as iron, cobalt, and nickel or from magnetic metal alloy such as iron alloy, cobalt alloy, and nickel alloy, for example. The heat roller 53 is formed in a hollow cylinder shape.

For example, the heat roller 53 has an outer diameter of 20 mm to 40 mm, and a thickness of 0.3 mm to 1.0 mm. Such heat roller 53 has a lower heat capacity, thereby a shorter temperature rise-up can be attained. The exemplary fixing roller 52 includes a metal core 52*a*, and an elastic member 52*b* formed on the metal core 52*a*. The metal core 52*a* can be made from metal such as stainless steel, for example.

The elastic member 52*b* can be made of rubber such as silicone rubber having heat resistancy, for example, wherein such rubber is in a solid form or a foamed form. The elastic member 52*b* preferably has a thickness of 5 mm, and a hardness of 30 Hs in Asker hardness, for example.

The fixing roller 52 preferably has an outer diameter which is larger than an outer diameter of the heat roller 53. The fixing roller 52 has an outer diameter of 30 mm, for example.

With such configuration, the heat roller 53 can have heat capacity, which is smaller than that of the fixing roller 52. Accordingly, the heat roller 53 can be heated in a relatively shorter time, thereby a warm-up time of the fixing unit 20C can be shortened.

The fixing belt 51 extended by the heat roller 53 and the fixing roller 52 is heated at a contact portion W on the heat roller 53, wherein the heat roller 53 is heated by the induction heating unit 54.

An inner surface of the fixing belt 51 can be continuously heated when the fixing belt 51 travels by a rotation of the fixing roller 52 and the heat roller 53. Accordingly, the fixing belt 51 can be heated uniformly.

The fixing belt 51 includes a base material, a heat generating layer, an elastic layer as an intermediate layer, and a separation layer as a surface layer. The base material and the heat generating layer can be integrated as one layer in some cases.

The exemplary separation layer preferably has a thickness of 10 μm to 30 μm, and more preferably has a thickness of 15 μm, for example.

With such a configuration, a toner image T on, a recording medium P can effectively contact the surface layer (i.e., separation layer) of the fixing belt 51, thereby the toner image T can be uniformly heated and melted.

If a thickness of the surface layer (i.e., separation layer) is too small, the fixing belt 51 may have a lower heat capacity. In such a case, a surface temperature of the fixing belt 51 may decrease in a shorter time during a toner fixing-process, thereby fix-ability of the toner image may not be effectively secured.

On one hand, if a thickness of the surface layer (i.e., separation layer) is too large, the fixing belt 51 may have a larger heat capacity, thereby a warm-up time of the fixing unit 20C may become longer. Furthermore, in such a case, a surface temperature of the fixing belt 51 may be hard to decrease during a toner fixing process. In such a case, melted toners may not effectively aggregate on the recording medium P at an outlet portion of the fixing unit 20C, and the fixing belt 51 may not effectively exert its separation ability. Accordingly, a hot-offset phenomenon, in which toners adhere on the fixing belt 51, may occur.

The base material can include a magnetic metal such as iron, cobalt, and nickel, for example. Instead of such metal, the base material of the fixing belt 51 can include a resin having heat resistancy such as fluorine resin, polyamide resin, polyamide resin, polyamide-imide resin polyetheretherketone (PEEK) resin, polyethersulfone (PES) resin, and polyphenylene sulphide (PPS) resin, for example.

As shown in FIG. 4, the pressure roller 55 includes a metal core 55*a*, and an elastic layer 55*b* formed on the metal core 55*a*.

The metal core 55*a* can be made of metal having a larger thermal conductivity such as copper and aluminum, for example, and is formed into a cylinder shape. The metal core 55*a* can also be made of stainless steel.

The elastic layer 55*b* can be made of material having a larger heat resistancy and toner separation ability.

The pressure roller 55 presses the fixing roller 52 via the fixing belt 51, and the pressure roller 55 and the fixing roller 52 form a fixing nip portion N therebetween. In FIG. 4, the pressure roller 55 has a hardness, which is larger than that of the fixing roller 52.

Under such hardness condition, the pressure roller 55 may deform a surface of the fixing roller 52 (and the fixing belt 51), wherein the fixing roller 52 may deform its surface shape according to a surface shape of the pressure roller 55.

With such deformation, the recording medium P can closely follow the surface shape of the pressure roller 55, thereby the recording medium P can be effectively separated from the surface of the fixing belt 51.

The pressure roller 55 has an outer diameter of 30 mm, for example, which is substantially similar to that of the fixing roller 52.

The elastic layer 55*b* of the pressure roller 55 has a thickness of 1.0 mm to 2.0 mm, for example, which may be smaller than that of the fixing roller 52.

The pressure roller 55 has a hardness of 50 Hs to 70 Hs in Asker hardness, for example, which is larger than a hardness of the fixing roller 52 as above-mentioned.

Figure 5A:
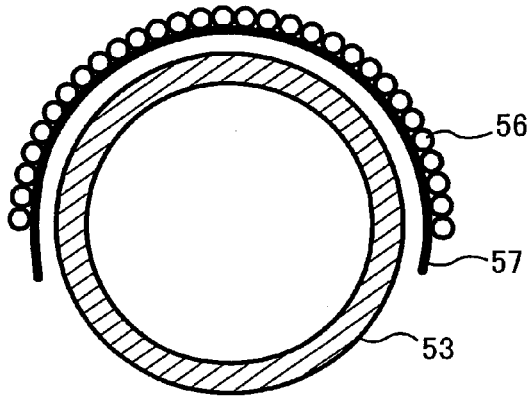
FIG. 5A is a schematic cross-sectional view of a winding condition of an exciting coil in a fixing unit.

The induction heating unit 54 heats the heat roller 53 with an electromagnetic induction method. As shown in FIGS. 4 and 5, the induction heating unit 54 includes an exciting coil 56, a coil guide plate 57, an exciting coil core 58, and a coil core supporter 59.

The exciting coil 56 is used to generate a magnetic field, and wound on the coil guide plate 57.

As shown in FIG. 4, the coil guide plate 57 is formed in a half cylinder shape, and disposed closely to the heat roller 53.

Figure 5B:
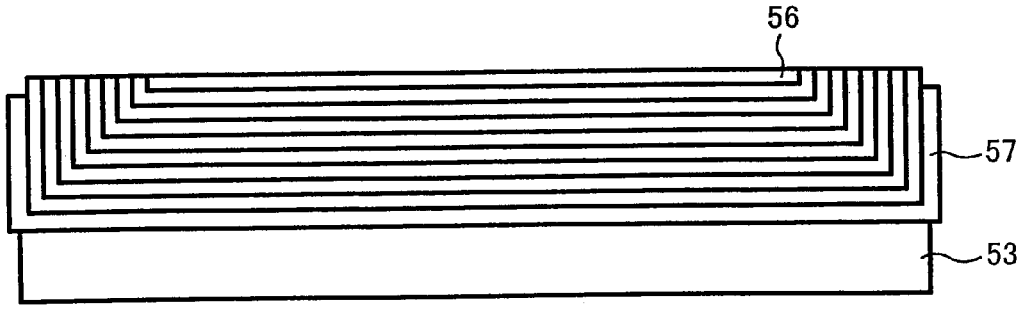
FIG. 5B is a schematic plan view of a winding condition of an exciting coil in a fixing unit.

As shown in FIG. 5B, the exciting coil 56 is made of one long exciting coil wire, and can be wound along the coil guide plate 57, for example.

The exciting coil 56 is connected to an oscillating circuit, which is connected to a power source (not shown) that can change frequency. The exciting coil core 58 can be made from ferromagnetic material such as ferrite, for example, and can be formed in half cylinder shape.

The coil core supporter 59 supports the exciting coil core 58, and the coil core supporter 59 and the exciting coil core 58 are disposed closely to the exciting coil 56 by facing the exciting coil core 58 to the exciting coil 56. In FIG. 4, the exciting coil core 58 has a relative magnetic permeability of 2500, for example.

A power source preferably supplies a high-frequency alternating current of 10 kHz to 1 MHz to the exciting coil 56, and more preferably supplies a high-frequency alternating current of 20 kHz to 800 kHz to the exciting coil 56 to generate an alternating magnetic field, for example.

Such alternating magnetic field gives an effect to the heat generating layer of the heat roller 53 and the heat generating layer of the fixing belt 51 at the contact portion W of the heat roller 53 and the fixing belt 51 and its vicinity.

When such alternating magnetic field gives an effect, an eddy current (not shown) is generated in the heat generating layer of the heat roller 53 and the fixing belt 51 in a direction, which can generate an alternating magnetic field having an opposite magnetic field direction with respect to the above-mentioned alternating magnetic field.

Such eddy current generates a joule heat in the heat generating layers of the heat roller 53 and the fixing belt 51, wherein such joule heat corresponds to the resistancy of the heat generating layers of the heat roller 53 and the fixing belt 51.

The heat roller 53 and the fixing belt 51 are heated by electromagnetic induction mainly at the contact portion W of the heat roller 53 and the fixing belt 51 and its vicinity.

Temperature of such heated fixing belt 51 can be detected by a temperature sensor 60 shown in FIG. 4. The temperature sensor 60 includes a thermo-sensitive device having a higher thermal responsiveness such as a thermistor, for example.

As shown in FIG. 4, the temperature sensor 60 can be disposed at proximity of an inlet of the fixing nip portion N by contacting an inner surface of the fixing belt 51 so that the temperature sensor 60 can detect the temperature of the inner surface of the fixing belt 51.

FIG. 6 is a schematic view explaining a driving system of a fixing unit and a temperature controlling system of a fixing unit. A configuration shown in FIG. 6 can be applied to the above-described fixing units 20A, 20B, and 20C with a similar manner:

The heat roller 23 can be driven by a motor 32 via gears, for example. The heat roller 23 includes the heating source 26 as above-described. A controller 30 controls a switch 31 to supply power to the heating source 26 from a commercial power source 33 as shown in FIG. 6. Hereinafter, a method of controlling a fixing unit in example embodiments is explained with reference to FIG. 7.

Figure 7:
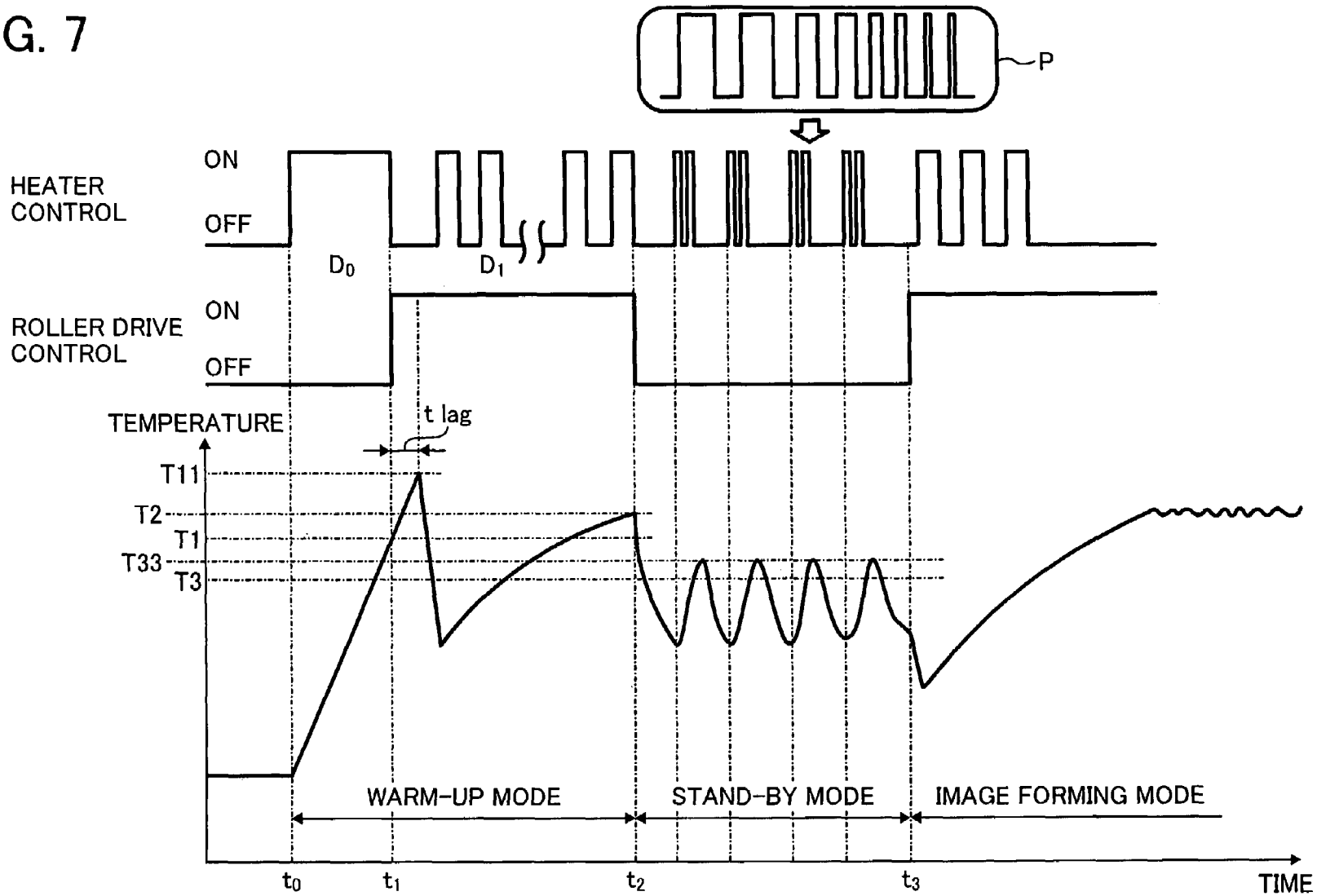
FIG. 7 shows timing charts of a method of controlling a fixing unit in an image forming apparatus of the invention.

FIG. 7 shows two timing charts and a graph for explaining a method of controlling a fixing unit in an image forming apparatus.

A first timing chart shown at the top of the FIG. 7 is a timing chart explaining a control of power supply to the heating source 26. Such control can be similarly applied to the heating source 46 and the induction heating unit 54.

A second timing chart shown at the middle of the FIG. 7 is a timing chart explaining a control of driving (or rotation) of the heat roller 23. Such control can be similarly applied to the fixing roller 41 and the heat roller 53.

A graph shown at the bottom of the FIG. 7 is a temperature graph explaining a temperature change of the heat roller 23, detected by the temperature sensor 27. Such detection can be similarly conducted by a temperature sensor 47 and temperature sensor 60.

In order to simplify explanation, a method of controlling a fixing unit in example embodiments is explained by using the fixing unit 20A as a representative, hereinafter.

As shown in FIG. 7, a warm-up mode of the fixing unit 20A starts when a power is supplied to the fixing unit 20A, at which time electric current is supplied to the heating source 26. Then the heating source 26 starts to generate heat, which is used to heat the heat roller 23. Accordingly, the temperature of the heat roller 23 increases as shown in FIG. 7 during time $t_0$ to $t_1$.

When the temperature sensor 27 detects a rise-up temperature T1 at time $t_1$, a signal for starting the driving of the fixing unit 20A and a signal for changing a heating on/off duty cycle (i.e., power on/off duty) of the heating source 26 are outputted from a controller (not shown).

As shown in the heating on/off duty in FIG. 7, an on-duty $D_0$ during the warm-up mode is changed to an on-duty $D_1$. at time $t_1$, wherein $D_1$ is smaller than $D_0$.

A signal for driving the heat roller 23 is supplied at time $t_1$. However, there is a time lag "t lag" between the time $t_1$ and a rotation starting time of the heat roller 23. Similarly, there is a time lag between the time $t_1$ and a time of changing the heating on/off duty.

Therefore, the temperature of the heat roller 23 continues to increase after time $t_1$, wherein such temperature increase is called overshooting.

When the heat roller 23 is ready for starting its rotation, the temperature of the heat roller 23 exceeds a target temperature T2 (or fixing control temperature) and reaches a temperature T11, which is higher than the target temperature T2 as shown in. FIG. 7.

Furthermore, the temperature sensor 27 may detect heat generated by the heating source 26 with some time lag because the heating source 26 is provided inside the heat roller 23.

Therefore, the rise-up temperature T1 is preferably set to a level that is lower than the target temperature T2 (or fixing control temperature).

The overshooting may be suppressed by lowering the power supply to the heating source 26. However, such method may decrease a temperature rising speed.

Accordingly, in order to shorten a warm-up time period, it is preferable to supply power with a higher power such as full-rated power until the temperature of the heat roller 23 reaches the rise-up temperature T1 at time $t_1$.

When the heat roller 23 starts to rotate, a portion of the fixing belt 21, which has not been warmed yet, comes to a position facing the temperature sensor 27, thereby the temperature detected by the temperature sensor 27 decreases as shown in FIG. 7. After a while, the fixing belt 21 is gradually heated so that the temperature detected by the temperature sensor 27 starts to increase again.

Compared to a non-rotating period of the heat roller 23, temperature increases in a moderate manner during a rotating period of the heat roller 23 because the fixing belt 21 dissipates heat along a traveling route of the fixing belt 21.

After the heat roller 23 starts to rotate, the on-duty of the heating source 26 can be set to a smaller level to suppress an overshooting of the temperature and to obtain an adequate fixing condition. With such method, the heat roller 23 can be effectively supplied with power for rotating the heat roller 23.

When the temperature of the heat roller 23 reaches the target temperature T2 at time t2, the heating source 26 is deactivated, and a rotation of the heat roller 23 is stopped.

After the above-described warm-up mode period, the fixing unit 20A shifts to stand-by mode.

In the example embodiment, as shown in FIG. 7, the fixing unit 20A uses a standby mode temperature T3, which is lower than the target temperature T2, to maintain a temperature of the fixing unit 20A and to save energy consumption during the stand-by mode period.

In case of shortening the warm-up time period, the fixing unit may be composed of parts having a smaller heat capacity.

If the standby mode temperature T3 is set to a level, which is higher than the target temperature T2, the heating source 26 may be deactivated (i.e., off condition) before an image forming process is started because the temperature has exceeded the target temperature T2. In such a case, temperature of the heat roller 23 decreases rapidly because the heating source 26 is deactivated (i.e., off condition) and the heat capacity of the beat roller 23 is relatively small.

In the example embodiment, the standby mode temperature T3 is set to a lower level compared to the target temperature T2.

Therefore, when to start an image forming process, the temperature control can be started from a temperature lower than the target temperature T2. By increasing the temperature from such level, the heating source 26 can be stably controlled by heater-on condition.

When conducting a temperature control at the standby mode temperature T3 during the standby mode period, a heater-off temperature T33 is set to a lower level compared to the rise-up temperature T1.

During the stand-by mode period, the on/off duty cycle of the heating source 26 (i.e., heater) is changed more frequently compared to during the warm-up period as shown in FIG. 7. For example, a duration of on-duty of the heating source 26 can be set to a smaller level during the stand-by mode period.

With such-controlling method, the standby mode temperature T3 can be accurately controlled. Based on such accurately controlled standby mode temperature T3, the temperature can be effectively controlled to the target temperature T2.

Furthermore, the on/off duty cycle of the heating source 26 can be changed, as required. For example, the on-duty of heating source 26 can be set to a smaller level as the temperature approaches the standby mode temperature T3 as shown in "P" in FIG. 7 (see the top of FIG. 7). If such on/off duty cycle is conducted, the overshooting may be more effectively suppressed.

At time $t_3$, a printing command is given to the image forming apparatus, which is in the stand-by mode, to start an image forming process. At time t3, the heating source 26 is activated to increase the temperature of the heat roller 23 from the standby mode temperature T3 to the target temperature T2 (or fixing control temperature).

In the example embodiment, the heat roller 23 starts to rotate right after the heating source 26 is activated.

If the heat roller 23 starts to rotate by interposing some time period from the activation time of the heating source 26, the temperature of the heat roller 23 may overshoot.

Because the cooled fixing belt 21 travels on the heat roller 23 for some time period after the heating source 26 is activated, the temperature of the heat roller 23 may decrease for some time period as shown in FIG. 7.

After such period, the temperature of the heat roller 23 gradually increases to the target temperature T2.

During such temperature increase period, the heating source 26 is controlled by the on/off duty cycle, wherein the on-duty duration during the temperature increase period can be set to a smaller level compared to during the stand-by mode.

When the heat roller 23 and the fixing belt 21 are rotating in the fixing unit 20A, heat can be distributed in the fixing unit 20A, thereby the fixing unit 20A is heated as a whole. Under such condition, temperature variations in the fixing unit 20A can be reduced.

Therefore, the on-duty of the heating source 26 during the temperature increase period can be set to a smaller level compared to during the stand-by mode, and the temperature can be controlled to the target temperature T2 without setting a preliminary temperature such as rise-up temperature Ti or standby mode temperature T3.

In an exemplary embodiment, the heating source is supplied with a first average power before the fixing unit is activated to drive a rotating member such as the fixing member and pressure member, and is supplied with a second average power after rotating the rotating member.

In such an exemplary embodiment, the on/off duty cycle of the power can be controlled in a manner so that the first average power is set to be larger than the second average power.

With such controlling, the temperature of the fixing member can be increased in a shorter time, which results into a shorter rise-up time of the fixing unit.

Furthermore, with such controlling, a temperature overshooting of the fixing member can be suppressed, and the temperature control of the fixing unit can be effectively conducted.

In the exemplary embodiment, the power can be supplied to the heating source continuously by an on-duty control before rotating the fixing member, and the power can be supplied to the heating source intermittently by an, on/off duty cycle after rotating the fixing member. Under such condition, the power supply to the heating source can be easily controlled, and the controller can take a simpler configuration.

Furthermore, a temperature difference between the target temperature and the detected temperature of the fixing member after rotating the fixing member is considered to determine the on/off duty cycle of the power supply. With such method, the fixing unit can be effectively controlled and the energy consumption of the image forming apparatus can be reduced.

Furthermore, a temperature of the fixing member (e.g., heat roller, fixing roller, and fixing belt) detected by a temperature sensor can be controlled to the rise-up temperature T1 before starting a rotation of the fixing member, wherein the rise-up temperature T1 is set to a lower level compared to the target temperature T2 (or fixing control temperature). And a temperature of the fixing member can be controlled to the target temperature T2 (or fixing control temperature) after starting a rotation of the fixing member.

With such temperature control, an overshooting of the temperature of the fixing member can be suppressed. As described above, the average power supply after rotating the fixing member can be controlled to a relatively smaller level. Under such condition, even if the power supply to the heating source is controlled to adjust the temperature of the fixing member to the target temperature T2, an overshooting of the temperature of the fixing member can be suppressed.

In the above-mentioned fixing units 20A and 20B, the heating source 26 and 46 includes a heater. As for the fixing units 20A and 20B, a following relationship can be set for the rise-up temperature T1 and the target temperature T2. $T1 \geqq (T2-\Delta T)$, wherein $\Delta T$=(heat quantity generated by heater)×(time lag of temperature detecting by temperature sensor)/(heat capacity between heater and temperature sensor).

If such relationship is satisfied, the temperature of the fixing member may continue to increase from the rise-up temperature T1 even if the heater is deactivated (i.e., off condition) when the temperature of the fixing member becomes the rise-up temperature T1 and exceeds the target temperature T2.

With such configuration, the temperature of the fixing member can be increased in a shorter time before rotating the fixing member and the pressure member, and the overshooting of temperature of the fixing member can be suppressed.

Hereinafter, an exemplary power supply configuration is explained in detail with reference to FIG. 8. Such configuration can be used with the above-described fixing units 20A, 20B, and 20C.

Figure 8:
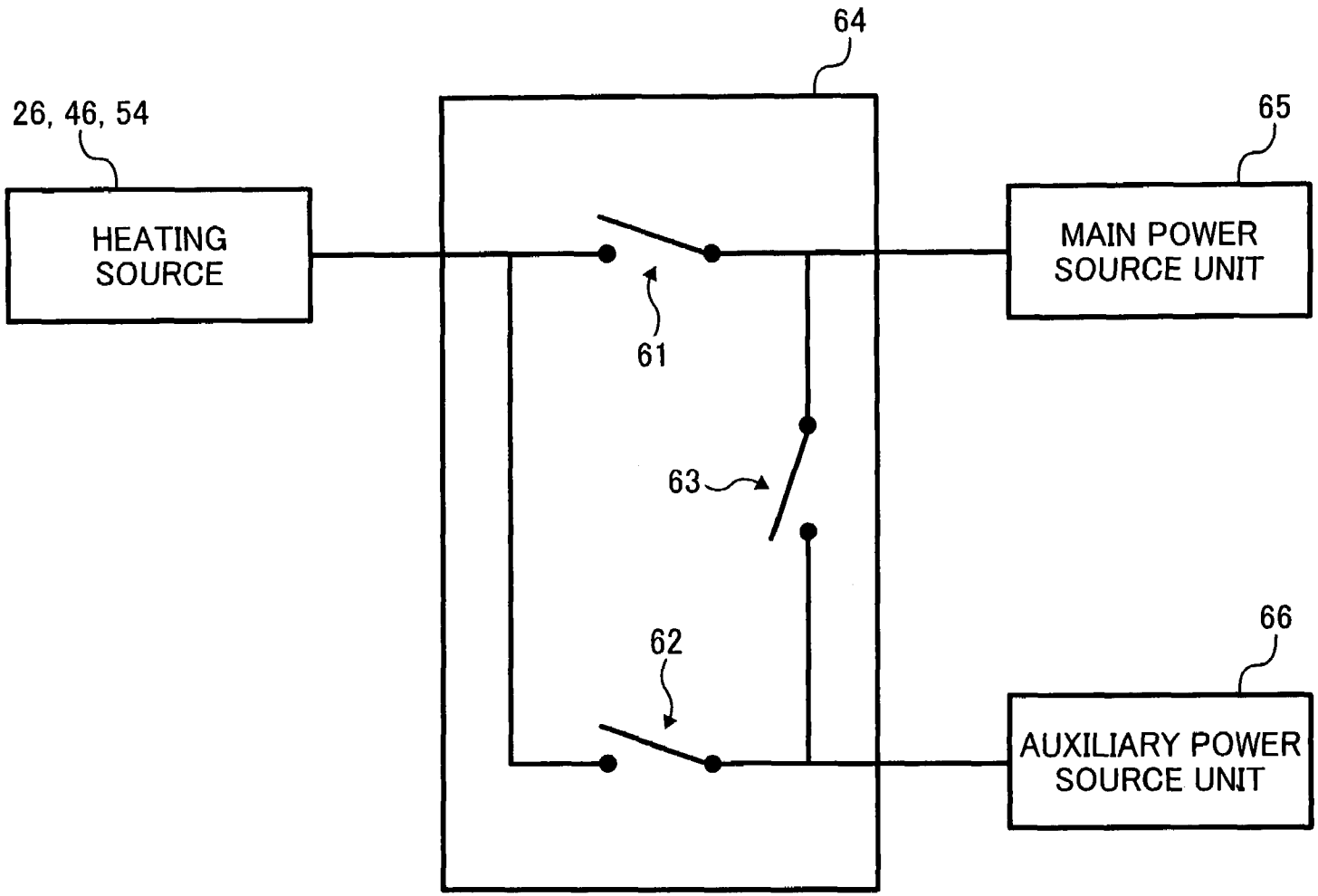
FIG. 8 is a block diagram for explaining a power source configuration for a fixing unit in accordance with an exemplary embodiment of the invention.

The power supply configuration shown in FIG. 8 includes at least two power sources to supply power to a heating source (e.g., heating source 26, heating source 46, induction heating unit 54) of a fixing unit.

Such two power sources include a main power source unit and an auxiliary power source unit as shown in FIG. 8. With such configuration, the power can be supplied to the fixing unit, which is in the stand-by mode, from both of the main power source unit and the auxiliary power source unit, thereby a larger amount of power can be supplied to the fixing unit, by which the fixing unit can be set in a fixing condition in a shorter time.

The main power source unit includes a commercial power source, which can be connected to an image forming apparatus using an electrical outlet provided in an apparatus installation area such as an office.

The auxiliary power source unit includes a capacitor, which can be recharged.

A switching unit connects the main power source unit to the heating source, wherein the main power source unit supplies power to the heating source to heat the heating source to a predetermined temperature.

When such heated heating source shift to the stand-by mode, the switching unit disconnects the main power source unit from the heating source, and connects the main power source unit to the auxiliary power source unit to charge the capacitor of the auxiliary power source unit.

When the heating source is activated from the stand-by mode, the switching unit connects the main power source unit and the auxiliary power source unit to the heating source to supply power to the heating source from both of the main power source unit and the capacitor of the auxiliary power source unit.

With such configuration for supplying the power from the main power source unit and the auxiliary power source unit to the heating source when the heating source is activated from the stand-by mode, a larger amount of power can be supplied to the heating source in a shorter time, by which the temperature of the heating source can be increased to a predetermined temperature in a shorter time.

Hereinafter, such configuration and controlling are explained in detail with reference to FIG. 8. FIG. 8 is a block diagram for power supply according to one example embodiment.

A main power source unit 65 in FIG. 8 can be connected to an image forming apparatus at an electrical outlet provided in an apparatus installation area such as an office. An auxiliary power source unit 66 includes a capacitor, which can be recharged. A switching unit 64 includes a first switch 61, a second switch 62, and a third switch 63.

The first switch 61 is provided between the main power source unit 65 and the heating source 26 for the fixing unit 20A. In case of the fixing unit 20B, the first switch 61 is provided between the main power source unit 65 and the heating source 46. In case of the fixing unit 20C, the first switch 61 is provided between the main power source unit 65 and the induction heating unit 54.

The second switch 62 is provided between the auxiliary power source unit 66 and the heating source 26 for the fixing unit 20A. In case of the fixing unit 20B, the second switch 62 is provided between the auxiliary power source unit 66 and the heating source 46. In case of the fixing unit 20C, the second switch 62 is provided between the auxiliary power source unit 66 and the induction heating unit 54.

The third switch 63 is provided between the main power source unit 65 and the auxiliary power source unit 66.

The main power source unit 65 includes functions such as voltage adjustment and rectification of alternating current and direct current to adjust power condition based on characteristics of the heating source.

The auxiliary power source unit 66 includes a capacitor, which can be recharged. The capacitor includes an electric double layer capacitor, wherein a product of Nippon Chemi-Con Corporation can be used as a capacitor, for example. Such electric double layer capacitor has an electrostatic capacity of approximately 2000 F, for example, and has an enough capacity for power supply to be conducted in several seconds or several ten seconds.

The switching unit 64 connects the main power source unit 65 and the auxiliary power source unit 66 to the heating source 26 to supply power to the heating source 26.

In addition, the switching unit 64 connects the main power source unit 65 to the auxiliary power source unit 66, by which the main power source unit 65 supplies power to the auxiliary power source unit 66 to charge the capacitor of the auxiliary power source unit 66.

Figure 9:
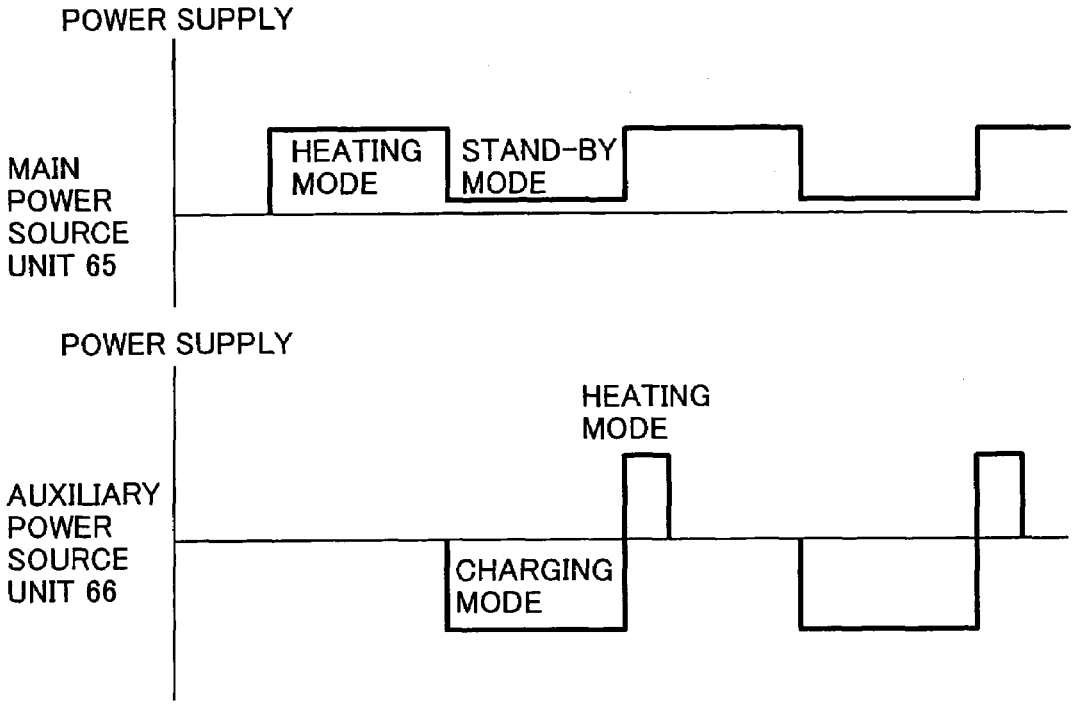
FIG. 9 is a timing chart of power source operations.

FIG. 9 is a timing chart for explaining operations of the power source explained with FIG. 8. Hereinafter, the fixing unit 20A is used to explain the timing chart of FIG. 9 as a representative of the fixing unit.

An upper timing chart in FIG. 9 explains a power supply condition from the main power source unit 65 to the heating source 26, and a lower timing chart in FIG. 9 explains a power supply condition from the auxiliary power source unit 66 to the heating source 26.

As shown in the upper timing chart in FIG. 9, the main power source unit 65 supplies a predetermined power to the heating source 26 when the heating source 26 is used for a fixing process, and supplies a relatively smaller power to the heating source 26 during the stand-by mode.

As shown in the lower timing chart in FIG. 9, the auxiliary power source unit 66 is charged during the stand-by mode, and the auxiliary power source unit 66 supplies a predetermined power to the heating source 26 to start heating of the heating source 26 for a faxing process. During the stand-by mode, a capacitor of the auxiliary power source unit 66 is recharged.

In FIG. 9, a horizontal line is written in the timing chart. In case of the main power source unit 65, the main power source unit 65 supplies power with varied level, thereby a line showing power supply by the main power source unit 65 comes above the horizontal line in FIG. 9. On one hand, in case of the auxiliary power source unit 66, the auxiliary power source unit 66 is charged by the main power source unit 65 during the stand-by mode, thereby a line such charging mode comes below the horizontal line in FIG. 9.

When the heating of the heating source 26 is started, the switching unit 64 connects the main power source unit 65 to the heating source 26 (i.e., first switch 61: close, second switch 62 and third switch 63: open).

Then, the main power source unit 65 supplies power to the heating source 26 to heat the heat roller 23 to a predetermined temperature. The heat roller 23 heats the fixing belt 21 to a predetermined temperature to fix a toner image to a recording medium.

When the fixing unit 20A shifts to the stand-by mode, the switching unit 64 disconnects the main power source unit 65 from the heating source 26, and connects the main power source unit 65 to the auxiliary power source unit 66 to charge a capacitor of the auxiliary power source unit 66 (i.e., first switch 61 and second switch 62: open, third switch 63: close).

The capacitor of the auxiliary power source unit 66 has a preferable property compared to a secondary battery because the capacitor does not need chemical reaction for charging.

For example, an auxiliary power source unit having a typical secondary battery such as nickel-cadmium cell needs several hours to charge the battery even if a quick charging is conducted. However, the auxiliary power source unit 66 having a capacitor can be charged in several minutes, for example.

Accordingly, when the stand-by mode and heating condition (i.e., image forming mode) are repeated, the auxiliary power source unit 66 having a capacitor can securely supply power to the heating source 26 when the fixing unit 20A is activated.

With such configuration, the temperature of the heating source 26 can be increased to a predetermined temperature in a shorter time.

Furthermore, a nickel-cadmium cell has a limitation on charge-discharge cycles such as 500 to 1,000 times, which is too short of a lifetime for an auxiliary power source unit used for heating a heating source, thereby such nickel-cadmium cell may increase maintenance cost such as replacement.

On one hand, an auxiliary power source unit having a capacitor has a relatively longer lifetime, and a degrading of the capacitor by repeated charge-discharge cycle can be suppressed to a lower level. Furthermore, the auxiliary power source unit having a capacitor does not need replacement or refilling of liquid solution, which is required for a lead-acid storage battery. Thereby, the, auxiliary power source unit having a capacitor can reduce maintenance cost such as replacement, and can be used in a stable manner.

Figure 10:
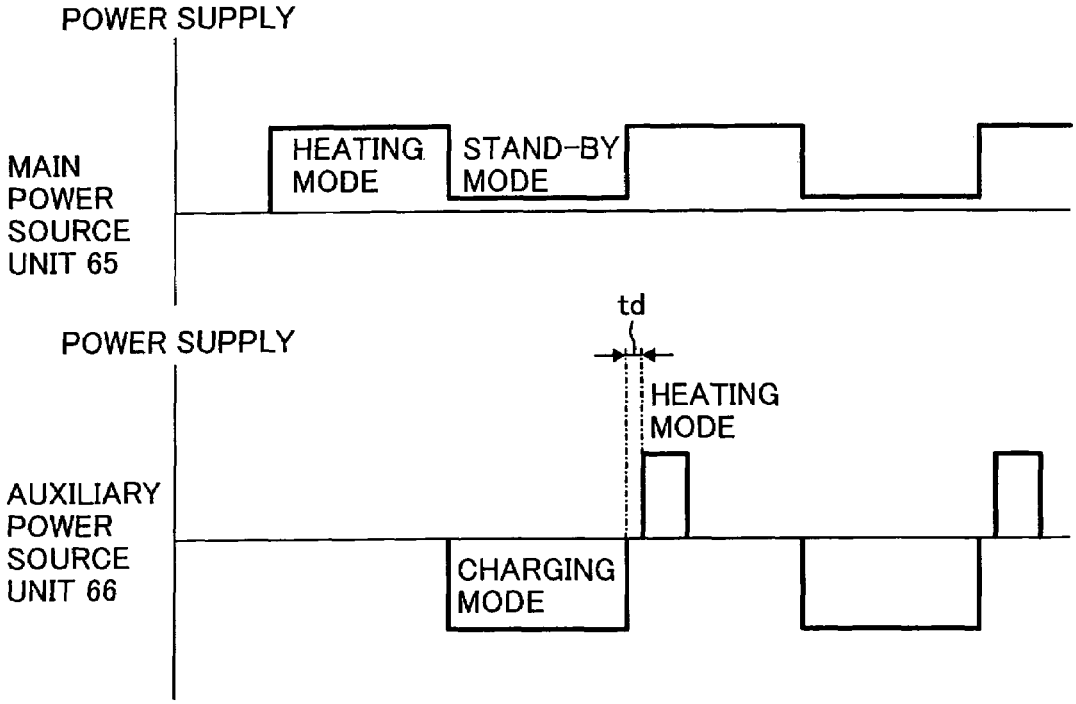
FIG. 10 is a timing chart of power source operations.

FIG. 10 is another timing chart for explaining operations of a power source.

As similar to FIG. 9, a horizontal line is written in the timing chart. In case of the main power source unit 65, the main power source unit 65 supplies power with varied level, thereby a line showing power supply by the main power source unit 65 comes above the horizontal line in FIG. 10. On one hand, in case of the auxiliary power source unit 66, the auxiliary power source unit 66 is charged by the main power source unit 65 during the stand-by mode, thereby a line showing a charging mode comes below the horizontal line in FIG. 10.

The timing chart in FIG. 9 explains a method of supplying power to the heating source 26 of the fixing unit 20A from both of the main power source unit 65 and the auxiliary power source unit 66 simultaneously when the fixing unit 20A shifts from a stand-by mode to an image forming mode.

On one hand, the timing chart in FIG. 10 explains a method of supplying power to the heating source 26 of the fixing unit 20A from both of the main power source unit 65 and the auxiliary power source unit 66 not simultaneously but with some time delay when the fixing unit 20A shifts from a stand-by mode to an image forming mode.

As shown in FIG. 10, the auxiliary power source unit 66 supplies power to the heating source 26 with a delayed time of "td" from a power supply timing from the main power source unit 65. Such method may be conducted to suppress an effect to a power source such as a commercial power source. For example, if a larger amount of electricity is supplied in a short period of time, the power source may receive an unfavorable effect such as destabilized power supply.

As above described with reference to FIGS. 9 and 10, when the fixing unit 20A is in the stand-by mode, the auxiliary power source unit 66 can be charged.

Accordingly, when the fixing unit 20A shifts from the standby mode to the heating condition (i.e., image forming mode), both of the main power source unit 65 and the auxiliary power source unit 66 can supply power to the heating source 26, thereby a larger amount of power can be supplied to the heating source 26 in a shorter time.

Therefore, the temperature of the heating source 26 can be increased to a predetermined temperature in a shorter time.

Although the present disclosure is explained with the above-mentioned drawings, the present disclosure is not limited to such embodiments.

For example, a fixing unit can employ any types of configurations for a fixing member such as heat roller, fixing roller, and fixing belt, as required. The heating source can include a heater, an induction heating unit, and resistance type, or the like, as required.

Furthermore, any configuration can be employed to extend a fixing belt, and a number of support rollers for extending a fixing belt can be chosen, as required. Furthermore, a heating source can be disposed at an outside or inside of a heat member such as a heat roller and fixing roller. Furthermore, an image forming apparatus can take any configurations for an image forming process. Furthermore, an image forming apparatus can include a copier, a printer, a facsimile, and a multifunctional apparatus having copier, printer, and facsimile functions.

Obviously, readily discernible modifications and variations of the present invention are possible in light of the above teachings. It is therefore to be understood that within the scope of the appended claims, the invention may be practiced otherwise than as specifically described herein. For example, while described in terms of both software and hardware components interactively cooperating, it is contemplated that the system described herein may be practiced entirely in software. The software may be embodied in a carrier such as magnetic or optical disk, or a radio frequency or audio frequency carrier wave.

Numerous additional modifications and variations are possible in light of the above teachings. It is therefore to be understood that within the scope of the appended claims, the disclosure of the present invention may be practiced otherwise than as specifically described herein. This application claims priority from Japanese patent application No. 2004-346883 filed on Nov. 30, 2004 in the Japan Patent Office, the entire contents of which are hereby incorporated by reference herein.

The invention claimed is:

1. An image forming apparatus, comprising:

a fixing member configured to be supported rotatably;

a heating source configured to heat the fixing member; and a controller configured to control power supplied to the heating source, wherein the controller provides a first average power supply, supplied to the heating source before rotating the fixing member, to be larger than a second average power supply, provided to the heating source after rotating the fixing member, and the controller sets a rise-up temperature of the fixing member which is lower than a target temperature of the fixing member, and the controller controls the power supplied to the heating source to heat the fixing member to the rise-up temperature before rotating the fixing member, and controls the power supply to the heating source to heat the fixing member to the target temperature after rotating the fixing member.

2. The image forming apparatus according to claim 1, wherein the controller conducts a continuous on-duty control for supplying the power to the heating source before rotating the fixing member, and conducts an on/off duty cycle control for supplying the power to the heating source after rotating the fixing member.

3. The image forming apparatus according to claim 2, further comprising:

a temperature sensor configured to detect a temperature of the fixing member, wherein the controller controls the on/off duty cycle for the fixing member based on a temperature difference between the target temperature and a temperature of the fixing member detected by the temperature sensor after rotating the fixing member.

4. The image forming apparatus according to claim 1, wherein the heating source includes a heater, and the heating source satisfies a relationship of (rise-up temperature)≧(target temperature)−ΔT, wherein the ΔT=(heat quantity generated by heater)×(time lag of temperature detecting by temperature sensor)/(heat capacity between heater and temperature sensor).

5. The image forming apparatus according to claim 1, wherein the fixing member includes an endless belt extended by a heat roller and a support roller, and the heat roller has a metal core having a thickness of about 0.8 mm or less.

6. The image forming apparatus according to claim 1, wherein the fixing member includes a fixing roller having a metal core having a thickness of about 0.8 mm or less.

7. The image forming apparatus according to claim 1, wherein the heating source includes an induction heater.

8. An image forming apparatus, comprising:

a fixing member configured to be supported rotatably;

a heating source configured to heat the fixing member;

means for controlling power supplied to the heating source to a first average power supply, supplied to the heating source before rotating the fixing member, to be larger than a second average power, supplied to the heating source after rotating the fixing member, wherein the means for controlling power sets a rise-up temperature of the fixing member which is lower than a target temperature of the fixing member, and the means for controlling power controls the power supplied to the heating source to heat the fixing member to the rise-up temperature before rotating the fixing member, and controls the power supply to the heating source to heat the fixing member to the target temperature after rotating the fixing member.

9. An image forming apparatus, comprising:

a photosensitive member configured to form a latent image thereon, a developing unit configured to develop the latent image as a toner image, a fixing unit configured to fix the toner image on a recording medium, including a fixing member configured to be supported rotatably;

a heating source configured to heat the fixing member; and a controller configured to control the power supply to the heating source, wherein the controller controls a first average power supply, supplied to the heating source before rotating the fixing member, to be larger than a second average power supply, supplied to the heating source after rotating the fixing member, and the controller sets a rise-up temperature of the fixing member which is lower than a target temperature of the fixing member, and the controller controls the power supplied to the heating source to heat the fixing member to the rise-up temperature before rotating the fixing member, and controls the power supply to the heating source to heat the fixing member to the target temperature after rotating the fixing member.

10. The image forming apparatus according to claim 9, further comprising:

a power source configured to supply power to the heating source, and wherein the power source includes a main power source unit and an auxiliary power source unit, and both of the main power source unit and the auxiliary power source unit supply the power to the heating source when the fixing unit shifts from a stand-by mode to a heating mode.

11. A method of controlling a fixing unit having a rotatable fixing member and a heating source for heating the fixing member for use in an image forming apparatus, the method comprising:

supplying a first average power to the heating source before rotating the fixing member;

supplying a second average power to the heating source after rotating the fixing member;

controlling the first average power to be larger than the second average power; and setting a rise-up temperature of the fixing member which is lower than a target temperature of the fixing member, wherein the controlling controls the power supplied to the heating source to heat the fixing member to the rise-up temperature before rotating the fixing member, and controls the power supply to the heating source to heat the fixing member to the target temperature after rotating the fixing member.

12. An image forming apparatus, comprising:

a fixing member configured to be supported rotatably;

a heating source configured to heat the fixing member;

a controller configured to control power supplied to the heating source, the controller is configured to provide a first average power supply, supplied to the heating source before rotating the fixing member, to be larger than a second average power supply, provided to the heating source after rotating the fixing member; and a power source configured to supply power to the heating source, the power source including a main power source unit and an auxiliary power source unit, and both of the main power source unit and the auxiliary power source unit supply the power to the heating source when the fixing unit shifts from a stand-by mode to a heating mode.

* * * * *